US005431156A

United States Patent [19]

Sundström

[11] Patent Number: 5,431,156

[45] Date of Patent: Jul. 11, 1995

[54] COMBINED HALF-MASK AND HOOD TYPE PROTECTIVE RESPIRATORY DEVICE

[75] Inventor: Michael Sundström, Lagan, Sweden

[73] Assignee: Sundström Safety AB, Lagan, Sweden

[21] Appl. No.: 256,275

[22] PCT Filed: Jan. 28, 1993

[86] PCT No.: PCT/SE93/00057

§ 371 Date: Jul. 6, 1994

§ 102(e) Date: Jul. 6, 1994

[87] PCT Pub. No.: WO93/14819

PCT Pub. Date: Aug. 5, 1993

[30] Foreign Application Priority Data

Jan. 31, 1992 [SE] Sweden ..... 9200274

[51] Int. Cl.[6] ..... A62B 18/00

[52] U.S. Cl. ..... 128/201.23; 2/9; 128/201.25

[58] Field of Search ..... 128/201.22, 201.23, 128/201.24, 201.25; 2/9, 424, 428

[56] References Cited

U.S. PATENT DOCUMENTS

| | | | |
|---|---|---|---|
| H1,316 | 6/1994 | McGuinness | 128/201.25 |
| 2,821,192 | 6/1958 | Monro | 128/201.25 |
| 4,506,667 | 3/1985 | Ansite | 128/201.25 |
| 4,595,003 | 6/1986 | Shoemaker et al. | 128/201.25 |

FOREIGN PATENT DOCUMENTS

| | | | |
|---|---|---|---|
| 801176 | 5/1936 | Germany | 128/201.25 |
| 510491 | 8/1939 | United Kingdom | 128/201.25 |

*Primary Examiner*—Edgar S. Burr
*Assistant Examiner*—V. Srivastava
*Attorney, Agent, or Firm*—Shapiro and Shapiro

[57] ABSTRACT

A protective respiratory device (1) in the form of a half-mask (2) is designed to cover the nose and the mouth of the wearer and is combined with a bag-shaped hood (3) designed to enclose the head of the wearer and provided with a visor (12) in front. Round the bag opening, the hood (3) is provided with an elastic sleeve designed to surround the neck of the wearer in a tight-fitting fashion. A first elastic band (9) arranged in the hood extends between the two sides of the half-mask and is intended to be applied round the back of the head or the nape of the neck of the wearer. A second elastic band (13) arranged in the hood and extending rearwards from a hood portion corresponding to the forehead of the wearer is connected to the first band (9) at the back. The second band (13) is adapted to be placed over the crown of the head of the wearer and has such a width that it will then largely surround the head of the wearer also laterally.

1 Claim, 1 Drawing Sheet

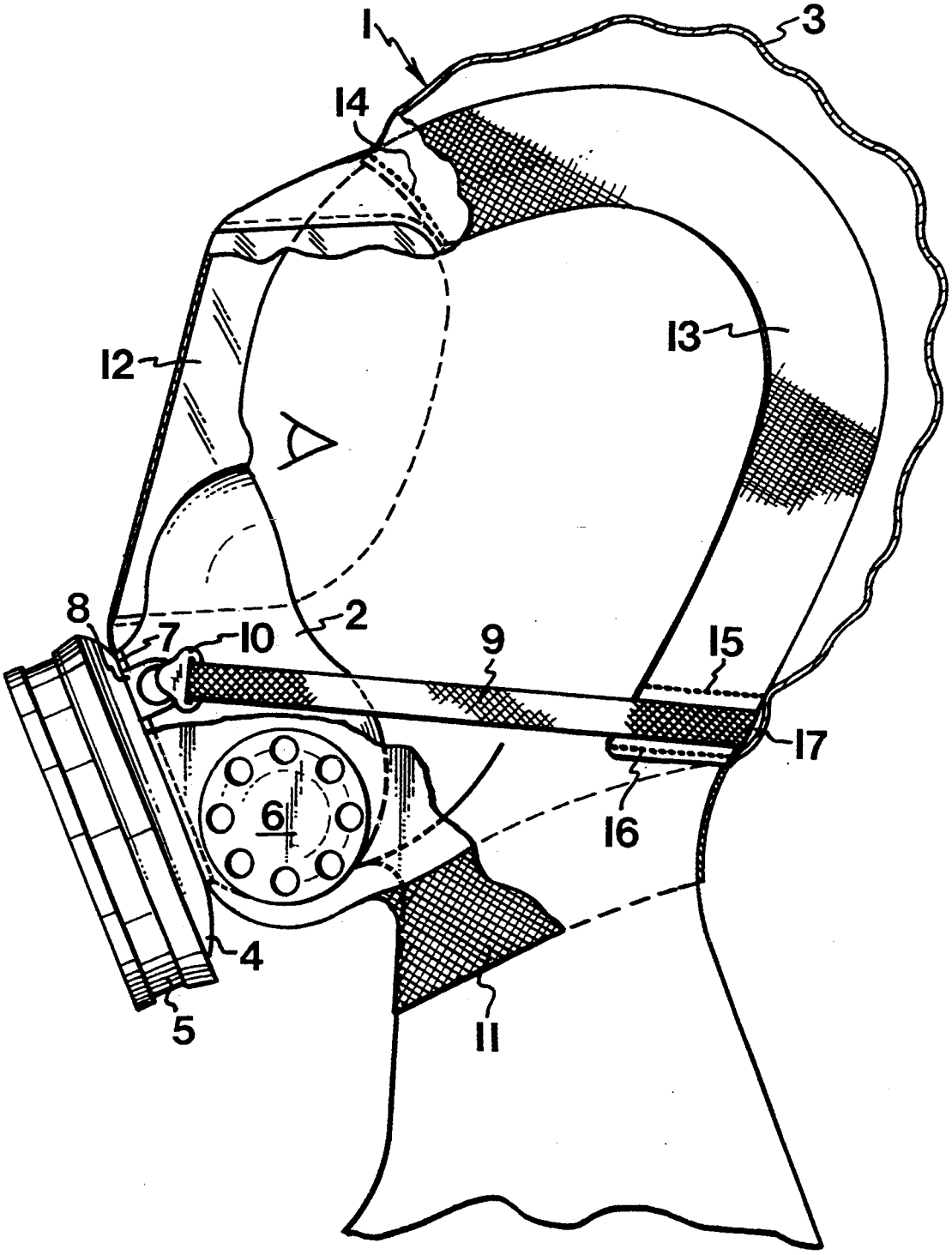
1
3
14
13
12
8
7
10
2
9
15
17
6
16
4
5
11

COMBINED HALF-MASK AND HOOD TYPE PROTECTIVE RESPIRATORY DEVICE

BACKGROUND OF THE INVENTION

The present invention relates to a protective respiratory device in the form of a half-mask designed to cover the nose and the mouth of the wearer and combined with a hood designed to enclose the head of the wearer and provided with a visor in front.

It is essential to the function of such protective respiratory devices, as well as devices without a hood, that the mask, whether a full-face mask or a half-mask, is applied in a tight-fitting fashion to the face of the wearer. To this end, protective respiratory devices are usually equipped with elastic and length-adjustable bands, more specifically a first band extending from the two sides of the mask round the nape of the neck of the wearer, a second band extending from the two sides of the mask round the back of the head, and, in the case of a full-face mask, a third band extending from an upper portion of the mask rearwards over the crown of the head to be connected to at least one of the other two bands.

It is true that the elasticity and the adjustability in length of the bands make it possible to adapt a protective respiratory device to fit each particular wearer. However, such adaptation is time-consuming and should preferably be done well in time before use, i.e. not when an emergency arises, which may make people panic, yet necessitating quick application of the device. Especially, this goes for so-called escape hoods, which are intended to be used in the event of a gas emission or a fire and which are a combination of a half-mask covering the nose and the mouth of the wearer, and a hood enclosing the head of the wearer, since the bands for keeping the half-mask in place are often so arranged under the hood as to be difficult of access. Also, prior-art protective respiratory devices often require some readjustment of the length of the bands or their position round the head to be completely tight.

SUMMARY OF THE INVENTION

In view of the deficiencies of prior-art protective respiratory devices, an object of the present invention is to provide a protective respiratory device of the type mentioned by way of introduction, which does not require any adjustment of the band length, neither before nor after application of the mask, and which further does not require any readjustment of the position of the bands round the head by virtue of an ingenious arrangement of the bands.

This object is achieved by a protective respiratory device which is characterised by a first elastic band provided inside the hood and extending between the two sides of the half-mask to be applied round the back of the head or the nape of the neck of the wearer, and a second elastic band which is provided inside the hood and fixed therein in front and at the back and which extends rearwards from a portion of the hood corresponding to the forehead of the wearer and is connected to the first band, the second band being made of a soft elastic ribbon material and intended to be placed over the crown of the head of the wearer and having such a width as then to surround the head of the wearer to a large extent also laterally, the hood being, round the bag opening, provided with an elastic sleeve designed to surround the neck of the wearer in a tight-fitting fashion.

Thanks to the combination of a first elastic band extending preferably round the nape of the neck, and an exceptionally broad second elastic band extending straight back over the crown of the head, the protective respiratory device according to the invention is extremely easy to put on. Thus, after pressing the mask against the face, one merely has to pull the junction of the two bands back over the head to position the bands. The length of the bands need not be adjusted, primarily because the large width of the second band makes it possible to choose a very soft elastic ribbon material for this band and still achieve the forces required for fixing the mask in place, both vertically and laterally.

BRIEF DESCRIPTION OF THE DRAWING

A preferred embodiment of the invention will be described in more detail below with reference to the accompanying drawing, which is a side view of an escape hood, certain parts being broken away for greater clarity.

DESCRIPTION OF THE PREFERRED EMBODIMENT

The accompanying drawing shows an escape hood 1 in accordance with the present invention and which is intended for use in emergency situations, e.g. in the case of fire or gas emissions. The hood comprises a protective respiratory device in the form of a half-mask 2 designed to cover the nose and the mouth of the wearer, and a hood 3 designed to be passed over the head.

The mask 2 is made of soft silicone rubber and is, in front, provided with a filter holder 4 carrying a replaceable filter 5. This filter may be a gas filter or a particle filter, or a combination of the two. Inwardly of the filter 5, the mask 2 has an inhalation valve (not shown), and on both sides, the mask has exhalation valves 6. All the valves are common non-return valves with easily movable membranes of silicone rubber.

In the transitional area between the facial portion of the mask 2 and the filter holder 4, the mask 2 has a circumferential recess in which a flat ring 7 is non-rotatably applied in a form-fitting manner. On both sides of the mask 2, approximately on a level with the mouth of the wearer, the ring 7 has attachments 8 in which a first elastic band 9 is fixed by snap-on hooks 10. The band 9 is intended to extend between the two sides of the mask 2 round the nape of the neck to apply the mask 2 in a tight-fitting fashion against the face of the wearer.

The hood 3, which is made of a flexible gastight material, is bag-shaped and has, round the "bag opening", an elastic sleeve 11 which is so elastic that the hood 3 can readily be passed over the head of the wearer. Once the hood 3 is in place, the sleeve is intended to surround the neck of the wearer in a tight-fitting fashion. In front and just opposite the eyes of the wearer, the hood 3 has another opening in which a visor 12 is provided. The visor 12, which is sealed against the hood 3, is made of rigid transparent plastic and is so large that the visual field of the wearer is but insignificantly restricted.

Apart from the two openings mentioned above, the hood 3 has openings through which the filter holder 4 and the exhalation valves 6 sealingly extend. The filter holder 4 with the associated filter 5 and the exhalation valves 6 are thus the only parts of the half-mask 2 that are not contained in the hood 3.

A second elastic band 13, provided inside the hood 3 and intended to extend from the forehead of the wearer, over the crown of the head, and down to the nape of the neck, is fixed to the front of the hood by a first seam 14 which approximately follows the hair line of the wearer. This band is fixed to the back of the hood by two substantially horizontal seams 15, 16. The seams 15, 16 are provided each on one side of the first band 9, thereby forming a channel 17, through which the first band 9 passes, between the second band 13 and the hood 3.

The second elastic band 13 is very broad. When the wearer puts on the protective respiratory device 1, this band surrounds the head, not only in the longitudinal direction from the forehead down to the nape of the neck, but also laterally to such an extent that every tendency towards unintentional displacement of the mask is obviated, vertically as well as laterally. Owing to its considerable width, the second band 13 may, in addition, be made of a very soft and pliable elastic ribbon material. As a result, the protective respiratory device 1 fits just about everyone, regardless of head size, despite the fact that the second band 13, like the first band 9, has no means for adjusting the band length.

I claim:

1. A protective respiratory device comprising a half-mask (2) designed to cover the nose and the mouth of the wearer, combined with a bag-shaped hood (3) designed to enclose the head of the wearer and provided with a visor (12) in front, characterised by a first elastic band (9) provided inside the hood (3) and extending between two sides of the half-mask (2) to be applied around the back of the head or the nape of the neck of the wearer, and a second elastic band (13) which is provided inside the hood (3) and fixed therein in front and at the back and which extends rearwards from a portion of the hood (3) corresponding to the forehead of the wearer and is connected to the first band (9), the second band (13) being made of a soft elastic ribbon material and arranged to be placed over the crown of the head of the wearer and having such a width as then to surround the head of the wearer to a large extent also laterally, the hood (3) being, around an opening thereof, provided with an elastic sleeve (11) designed to surround the neck of the wearer in a tight-fitting fashion.

* * * * *